US010352207B2

(12) United States Patent
Ishihara et al.

(10) Patent No.: US 10,352,207 B2
(45) Date of Patent: Jul. 16, 2019

(54) FOUR-CYCLE OHV ENGINE

(71) Applicant: SUZUKI MOTOR CORPORATION, Hamamatsu-Shi, Shizuoka (JP)

(72) Inventors: Yasuomi Ishihara, Hamamatsu (JP); Hideto Nakamura, Hamamatsu (JP)

(73) Assignee: SUZUKI MOTOR CORPORATION, Shizuoka (JP)

( * ) Notice: Subject to any disclaimer, the term of this patent is extended or adjusted under 35 U.S.C. 154(b) by 498 days.

(21) Appl. No.: 15/254,778

(22) Filed: Sep. 1, 2016

(65) Prior Publication Data

US 2017/0067378 A1 Mar. 9, 2017

(30) Foreign Application Priority Data

Sep. 4, 2015 (JP) ..... 2015-175132

(51) Int. Cl.

| | |
|---|---|
| ***F01M 1/16*** | (2006.01) |
| ***F02B 75/00*** | (2006.01) |
| ***F02B 61/04*** | (2006.01) |
| ***F01M 1/20*** | (2006.01) |
| ***F01M 1/10*** | (2006.01) |
| ***F01M 9/10*** | (2006.01) |
| ***F02M 35/10*** | (2006.01) |
| *F02B 75/02* | (2006.01) |

(52) U.S. Cl.

CPC ..... *F01M 1/16* (2013.01); *F01M 1/10* (2013.01); *F01M 1/20* (2013.01); *F01M 9/106* (2013.01); *F02B 61/045* (2013.01); *F02B 75/007* (2013.01); *F02M 35/1015* (2013.01); *F02B 2075/027* (2013.01)

(58) Field of Classification Search

CPC ..... F01M 1/16; F01M 9/106; F01M 1/10; F01M 1/20; F02M 35/1015; F02B 61/045; F02B 75/007; F02B 2075/027

See application file for complete search history.

(56) References Cited

U.S. PATENT DOCUMENTS 5,947,230 A * 9/1999 Ohta ..... F01M 1/16 123/196 CP
6,305,999 B1 * 10/2001 Toyama ..... B63H 20/32 440/88 G (Continued)

FOREIGN PATENT DOCUMENTS

JP 2500975 Y2 5/1996

*Primary Examiner* — Hung Q Nguyen

(74) *Attorney, Agent, or Firm* — Troutman Sanders LLP

(57) ABSTRACT

An engine case includes bearings, an oil pump, lubricating oil passages, and a relief device. The bearings rotatably support a crankshaft and a camshaft. The oil pump and the lubricating oil passages are configured to pressure-feed lubricating oil to the bearings. The relief device is configured to adjust a pressure of the lubricating oil. The lubricating oil passages include main lubricating oil passages. The main lubricating oil passages include communication portions linearly formed with extending portions. The communication portions communicate between the respective bearings of the crankshaft and the camshaft from outside the engine case. The extending portions extend from outside the engine case to the bearing of the camshaft. The relief device is disposed having a relief valve and a relief hole at the extending portions.

8 Claims, 8 Drawing Sheets

(56) References Cited

U.S. PATENT DOCUMENTS 6,536,400 B1 * 3/2003 Inumaru ..... F01M 1/16
123/196 R
7,308,882 B2 * 12/2007 Suzuki ..... F01M 1/02
123/196 CP

* cited by examiner

SEC I - I

SEC II-II

FOUR-CYCLE OHV ENGINE

CROSS-REFERENCE TO RELATED APPLICATIONS

This application is based upon and claims the benefit of priority of the prior Japanese Patent Application No. 2015-175132, filed on Sep. 4, 2015, the entire contents of which are incorporated herein by reference.

BACKGROUND OF THE INVENTION

Field of the Invention

The present invention relates to a four-cycle OHV engine preferable for an outboard motor and a similar device to which an internal combustion is mounted as a power source.

Description of the Related Art

As a relief structure of lubricating oil in a so-called vertical engine where a crankshaft is vertically placed, for example, a relief structure described in Patent Document 1 has been known. This relief structure couples an oil pump at a lower end of a camshaft. A pump chamber disposed at a lower side of a cam journal houses this oil pump. A wall that couples a crank journal, the cam journal, and an oil filter is formed integrally with a lower crankcase so as to partition an inside of this lower crankcase. Oil passing holes that communicate with the crank journal, the pump chamber, and the oil filter are formed on the inner wall. At one side of the wall between the crank journal and the cam journal, an outlet side of a relief hole communicating with the oil passing hole is open.

To process the relief structure according to Patent Document 1, concurrently with a process of linearly coupling the crankshaft of the crankcase, the camshaft, and the oil filter, a process of coupling an oil relief hole, the camshaft, and the oil filter is given.

Patent Document 1: Japanese Registered Utility Model No. 25009%5

The vertical engine with the conventional lubricating oil relief structure includes the oil filter on an extended line coupling the crankshaft and the camshaft; therefore, the oil filter projects outside and there is no choice but to increase an engine size. To mount a relief valve for lubricating oil, processing is required to an inside of the lower crankcase in a crankshaft direction, causing a problem such as an increase in the number of man-hours for the process.

SUMMARY OF THE INVENTION

The present invention has been made to solve the above-described problems. An object of the present invention is to provide a four-cycle OHV engine configured to effectively achieve a compact engine, an improvement in workability, and a similar feature.

A four-cycle OHV engine of the present invention includes a crankshaft, and a camshaft. The crankshaft is disposed in a vertical direction. The camshaft is parallel to the crankshaft in an engine case where the crankshaft is housed and supported. The cylinder axis line is perpendicular to the vertical direction. The engine case includes bearings, an oil pump, lubricating oil passages, and a relief device. The bearings rotatably support the crankshaft and the camshaft. The oil pump and the lubricating oil passages are configured to pressure-feed lubricating oil to the bearings. The relief device is configured to adjust a pressure of the lubricating oil. The lubricating oil passages include main lubricating oil passages. The main lubricating oil passages include communication portions linearly formed with extending portions. The communication portions communicate between the respective bearings of the crankshaft and the camshaft from outside the engine case. The extending portions extend from outside the engine case to the bearing of the camshaft. The relief device is disposed having a relief valve and a relief hole at the extending portions.

The four-cycle OHV engine of the present invention is configured as follows. An oil filter is disposed on a cylinder head side with respect to the engine case and a side portion on one side in a width direction of a cylinder body. The oil filter includes a lubricating oil passage. The lubricating oil passage is coupled to the oil pump and the main lubricating oil passages disposed in the lower engine case.

The four-cycle OHV engine of the present invention is configured as follows. The oil pump is disposed in the lower engine case corresponding to a shaft end portion of the camshaft. The camshaft is disposed biased to the cylinder head side with respect to the crankshaft. The main lubricating oil passages are disposed inclined in the cylinder head direction such that outer portions of the main lubricating oil passages intersect with the cylinder axis line at an acute angle.

The four-cycle OHV engine of the present invention is configured as follows. The relief valve is formed of a valve element that advances and retreats along an axis line of the main lubricating oil passage. The relief valve includes a retainer. The retainer obstructs an outer opening. The outer opening is disposed at the extending portion constituting the main lubricating oil passage. The outer opening opens to outside of the lower engine case.

The four-cycle OHV engine of the present invention is configured as follows. The engine case is divided into an upper engine case and the lower engine case both of which integrally include the cylinder body. On the lower engine case, an oil reservoir concaving downward, the respective bearings of the crankshaft and the camshaft, and the main lubricating oil passages are integrally formed with the oil pump and the relief device. The relief hole of the relief device is drilled upward parallel to the bearings of the respective crankshaft and camshaft on the main lubricating oil passage.

The four-cycle OHV engine of the present invention is configured as follows. An intake device is disposed at aside portion on the other side opposite from the oil filter in the width direction of the cylinder body across the cylinder axis line. The intake device is configured to supply air for engine combustion.

DETAILED DESCRIPTION OF THE PREFERRED EMBODIMENTS

The following describes preferable embodiments of a four-cycle OHV engine according to the present invention with reference to the drawings.

Figure 1:
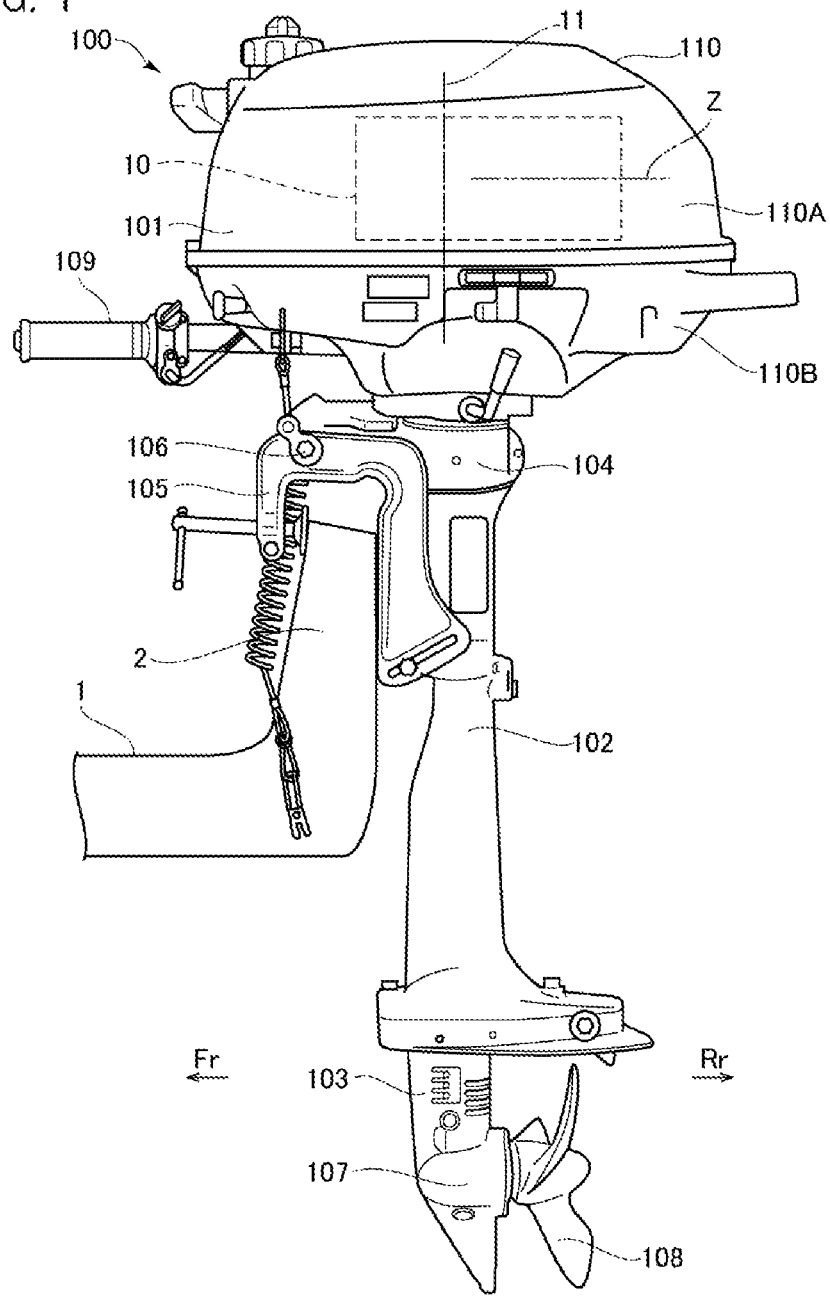
FIG. 1 is a left side view illustrating an example of a schematic configuration of an outboard motor according to the present invention.

FIG. 1 is a left side view illustrating an example of a schematic configuration of an outboard motor 100 as an application example of the present invention. In this example, the outboard motor 100 is secured to a rear plate 2 of a ship 1 at the front portion side as illustrated in the drawing. The outboard motor 100 is equipped with an engine 10 according to the present invention. The respective drawings in the following description indicate the front side of the outboard motor 100 or the engine 10 by an arrow Fr and the rear side of the outboard motor 100 or the engine 10 by an arrow Rr as necessary. An arrow R indicates the right lateral side of the outboard motor 100 while an arrow L indicates the left lateral side of the outboard motor 100.

In an overall configuration of the outboard motor 100, an upper unit (or a power unit) 101, a middle unit 102, and a lower unit 103 are disposed in this order from the top to the bottom. The engine 10 is mounted in the upper unit 101, and as described later, a crankshaft 11 is vertically mounted and supported so as to face a vertical direction. As the engine 10, typically a single cylinder engine is applicable. The middle unit 102 is supported so as to be horizontally turnable around a spindle configured at a swivel bracket 104. A pair of clamp brackets 105 (suspension devices) are disposed both right and left sides of the swivel bracket 104. Both of the clamp brackets 105 are coupled via a tilt shaft 106 configured in a right-left direction. The clamp brackets 105 are secured to the rear plate 2 of the ship 1. The entire outboard motor 100 is turnably supported vertically around the tilt shaft 106 via the swivel bracket 104.

In the middle unit 102, more specifically in a drive shaft housing, a drive shaft coupling to a lower end portion of the crankshaft 11 vertically penetrates. A driving power of this drive shaft is transmitted to a propeller shaft inside a gear case 107 of the lower unit 103. A propeller 108 is mounted to a rear end of this the propeller shaft. The power from the engine 10 goes through a power transmission path, which is constituted of the crankshaft, the drive shaft, the propeller shaft, and a similar member, and is finally transmitted to the propeller 108 to ensure rotatably driving the propeller 108. A steering handle 109 (a steering gear) is appropriately turned to ensure steering the propeller 108 at a desired angle.

In the above-described case, the upper unit 101 is covered with an exterior cover 110. The exterior cover 110 includes an upper cover 110A, which covers around the upper portion, and a lower cover 110B, which covers around the lower portion. Integral coupling of these members forms an appearance form with, for example, a schematic egg shape or a lemon shape as a whole.

Figure 2:
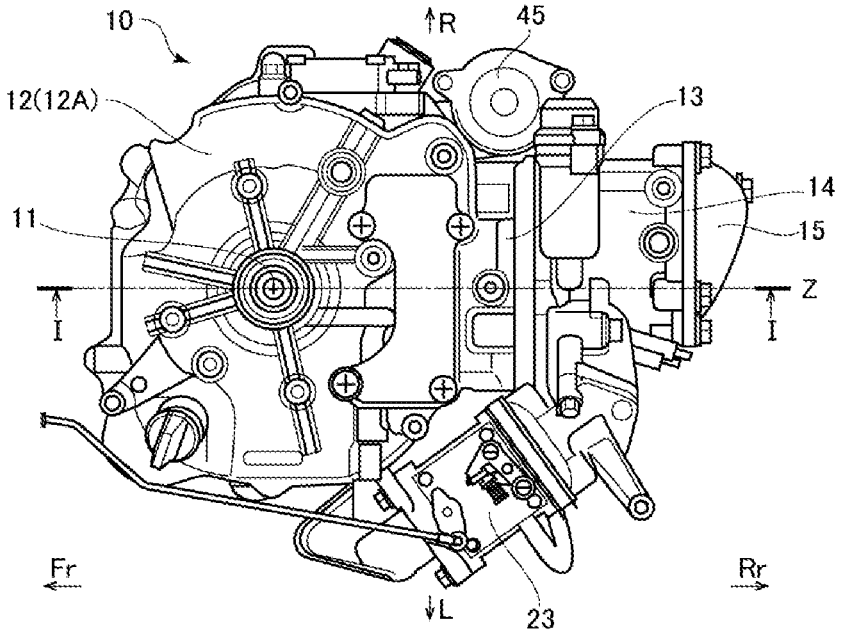
FIG. 2 is a top view of an engine according to the embodiment of the present invention.
Figure 3:
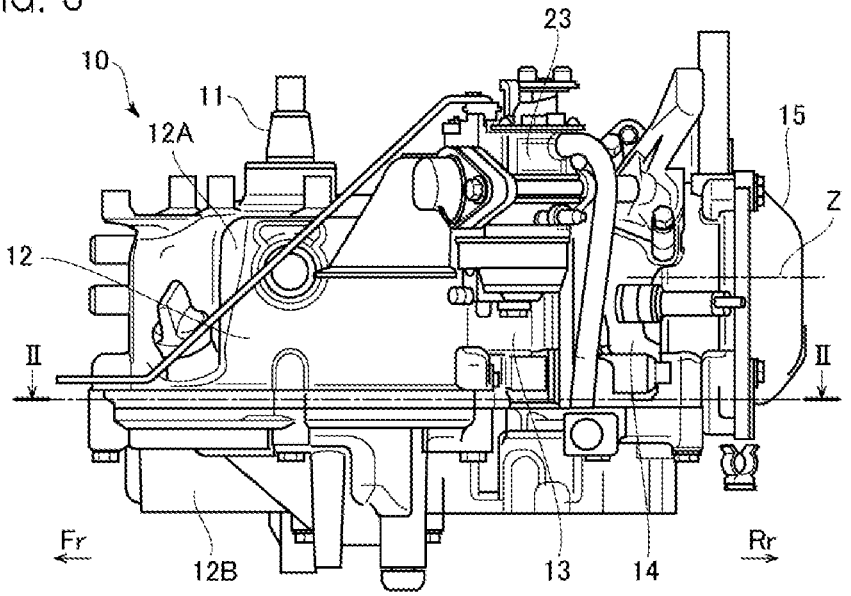
FIG. 3 is a side view of the engine according to the embodiment of the present invention.

The following describes the engine 10 according to the present invention. FIG. 2 is a top view of the engine 10 according to the embodiment, and FIG. 3 is a side view of the engine 10. This example uses an Over Head Valve (OHV) engine as the engine 10. The engine 10 is vertically mounted and supported via an engine holder such that the crankshaft 11 faces the vertical direction in the upper unit 101. As illustrated in FIG. 2 and a similar drawing, the engine 10 is configured by integrally joining a cylinder block 13 (a cylinder body), a cylinder head 14, and a cylinder head cover 15 sequentially at the rear of an engine case 12. When the outboard motor 100 is equipped to the ship 1 as illustrated in FIG. 1, typically as illustrated in FIG. 2 and FIG. 3, a cylinder axis line Z orients the rear side in a horizontal direction, which is perpendicular to the vertical direction.

Figure 4:
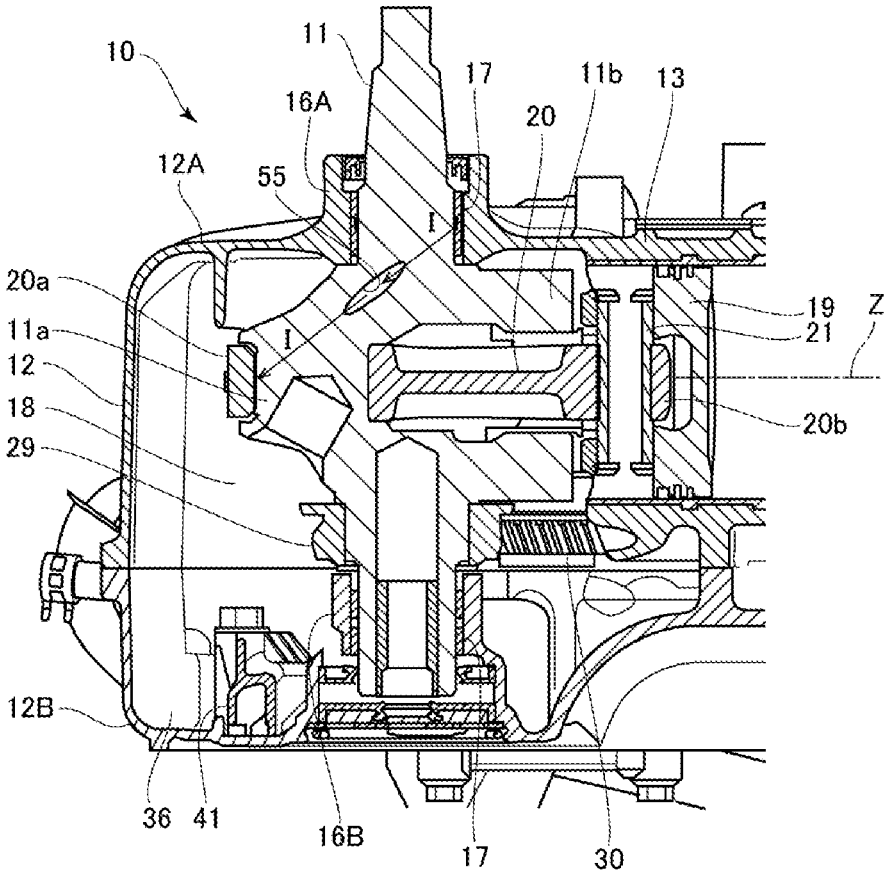
FIG. 4 is a cross-sectional view taken along the line I-I in FIG. 2.

The engine case 12 is divided into an upper engine case 12A and a lower engine case 12B both of which integrally include the cylinder block 13. As illustrated in FIG. 4, the crankshaft 11 is rotatably supported by a bearing 16A, which is disposed at the upper engine case 12A, and a bearing 16B, which is disposed at the lower engine case 12B, in a crank chamber 18. To these bearings 16A and 16B, sliding bearings 17 and a similar member are mounted. A piston 19 is housed in a cylinder bore, which is formed at the cylinder block 13, so as to be reciprocatable along the cylinder axis line Z direction. Also with reference to FIG. 5, the crankshaft 11 and the piston 19 are mutually coupled via a coupling rod 20. A large end portion 20*a* of the coupling rod 20 is coupled to a crank pin 11*a* of the crankshaft 11. A small end portion 20*b* of the coupling rod 20 is coupled to a piston pin 21 of the piston 19. A reciprocation motion of the piston 19 in the cylinder axis line Z direction inside the cylinder bore of the cylinder block 13 rotatably drives the crankshaft 11 via the coupling rod 20. A crank web 11*b* is attached to the crankshaft 11 for integral rotation with the crankshaft 11.

Although the detailed illustration is omitted, the cylinder head 14 includes a combustion chamber. In this combustion chamber, an intake port 22 (the position is abbreviated in FIG. 5) and an exhaust port, which communicate with the combustion chamber, are formed. As illustrated in FIG. 2 and FIG. 3, to the intake port 22, an intake device 23 with a throttle body is coupled. This intake device 23 supplies an air-fuel mixture to the combustion chamber via the intake port 22. In this example, the intake device 23 is disposed at a left side portion of the cylinder block 13. The exhaust port is coupled to the exhaust pipe to exhaust combustion gas generated in the combustion chamber as exhaust gas through the exhaust pipe.

Figure 5:
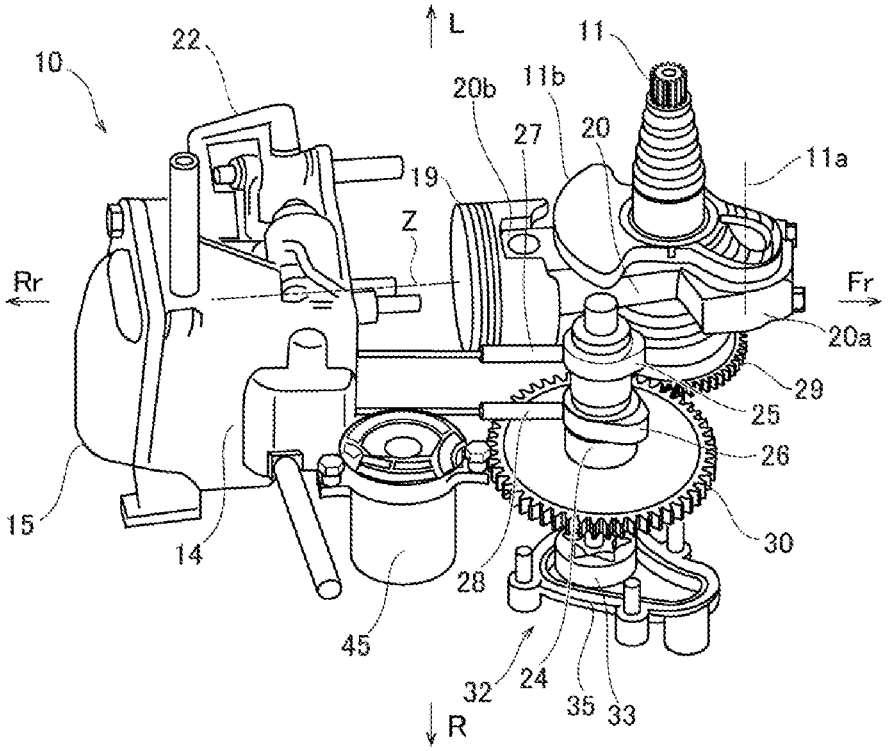
FIG. 5 is a perspective view illustrating an example of a main configuration of the engine according to the embodiment of the present invention.

An intake valve and an exhaust valve open and close, that is, communicate or obstruct between the combustion chamber and the intake port 22 and between the combustion chamber and the exhaust port, respectively at a predetermined timing. A valve mechanism to drive the opening and closing of these intake valve and exhaust valve are provided. As illustrated in FIG. 5, the engine 10 of this embodiment includes a camshaft 24 to drive the valve mechanism at a proximity of the right side of the crankshaft 11. The camshaft 24 is rotatably supported to the engine case 12 parallel to the crankshaft 11, that is, facing the vertical direction. Although the detailed illustration is omitted, the cylinder head 14 in the valve mechanism includes a rocker shaft. An intake-side rocker arm and an exhaust-side rocker arm are swingably journaled to this rocker shaft. Between the intake-side rocker arm and the camshaft 24 and between the exhaust-side rocker arm and the camshaft 24 are coupled via an intake-side cam 25 and an exhaust-side cam 26, which are disposed at the camshaft 24, and via an intake-side push rod 27 and an exhaust-side push rod 28, which are driven by the intake-side cam 25 and the exhaust-side cam 26. To the crankshaft 11 and the camshaft 24, a drive gear 29 and a driven gear 30 are mounted, respectively so as to be mutually engaged. The camshaft 24 is rotatably driven by the driving power from the crankshaft 11 at a predetermined reduction gear ratio (1/2 in this example). Through the rotation of the camshaft 24, the intake valve and the exhaust valve synchronize with the crankshaft 11 via the above-described coupling of the cams and push rods and are opened and closed at a predetermined timing.

Figure 6:
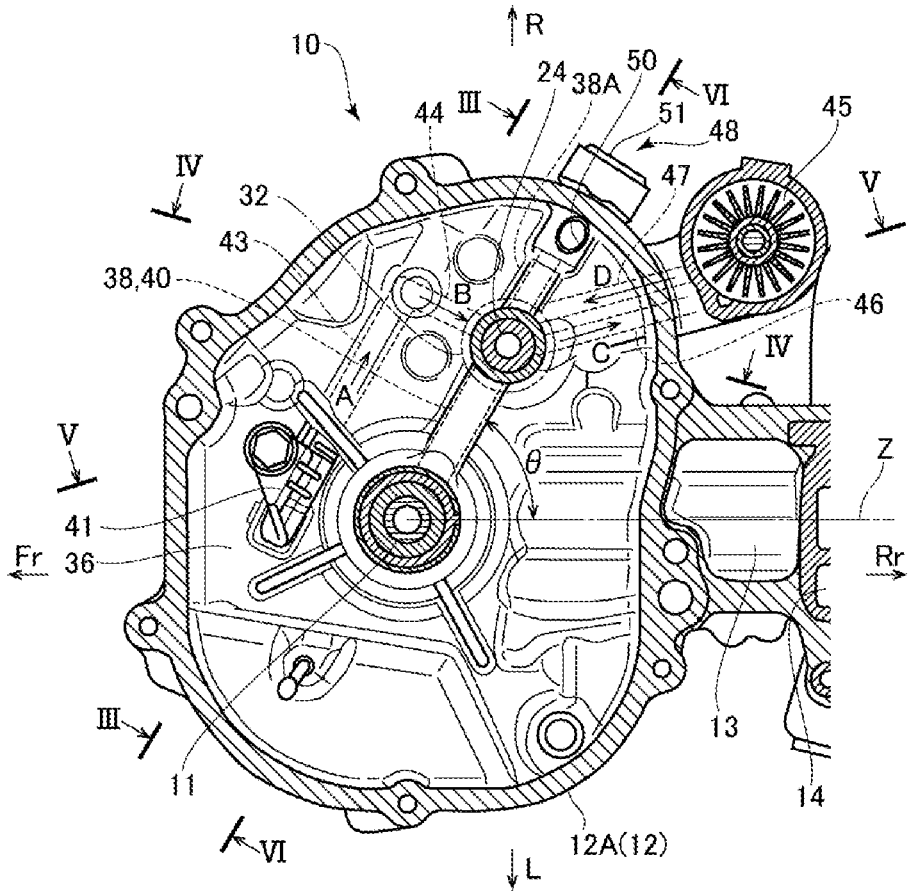
FIG. 6 is a cross-sectional view taken along the line II-II in FIG. 3.
Figure 8:
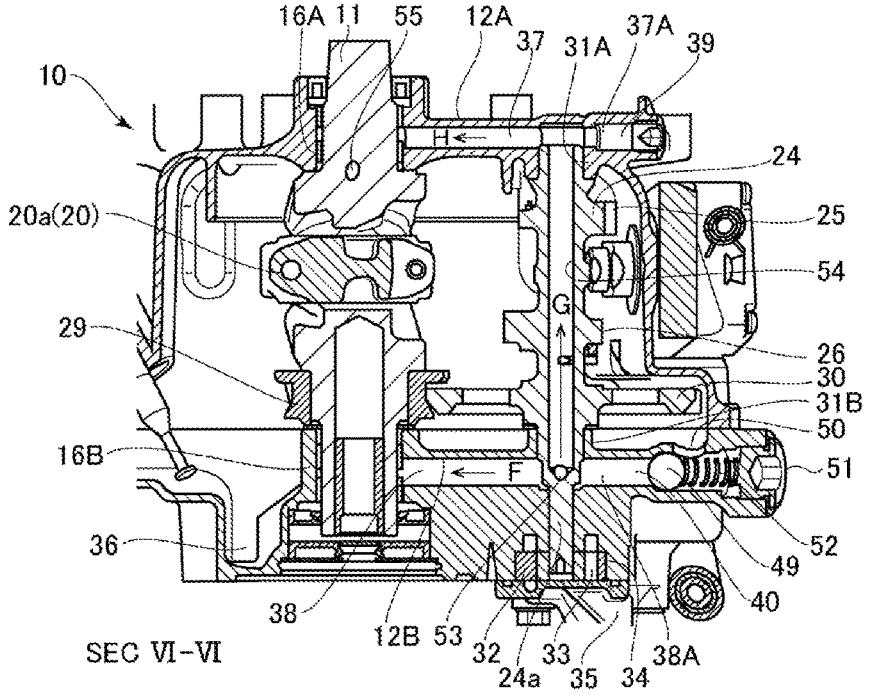
FIG. 8 is a cross-sectional view taken along the line VI-VI in FIG. 6.

As illustrated in FIG. 6, the camshaft 24 is disposed diagonally backward right near the crankshaft 11 with a predetermined interval from the crankshaft 11. That is, the camshaft 24 is biased to the cylinder head 14 side with respect to the crankshaft 11. With reference to FIG. 8, in the supporting structure of the camshaft 24, the camshaft 24 is rotatably supported inside the crank chamber 18 by bearings 31A and 31B, which are disposed in the upper engine case 12A and the lower engine case 12B, respectively. The bearing 16A and the bearing 31A, which are disposed at the crankshaft 11 and the camshaft 24 on the upper engine case 12A side, are configured at an approximately identical height position. Similarly, the respective bearing 16B and bearing 31B disposed at both on the lower engine case 12B side are configured at an approximately identical height position.

A lubricating device to lubricate around the crankshaft 11 including the bearings 16A and 16B, around the camshaft 24 including the bearings 31A and 31B, and a similar position is provided. The lubricating device of this embodiment includes an oil pump 32 (see FIG. 5) actuated by the crankshaft 11, directly the camshaft 24, as a driving source. As the oil pump 32, for example, a trochoid pump is employed. In this example, the oil pump 32 is coupled to and mounted to a lower end portion 24*a* (see FIG. 8) of the camshaft 24. In this case, as illustrated in FIG. 8, the lower end portion 24*a* of the camshaft 24 extends downward the bearing 31B and a rotor (an inner rotor) 33 of the oil pump 32 rotatably supports the lower end portion 24*a*. A casing 34 constituted using a part of the lower engine case 12B internally houses the rotor (the inner rotor and an outer rotor) 33 so as to be rotatable. The rotation of the camshaft 24 ensures driving the oil pump 32. A pump cover 35 covers the casing 34. The engine 10 includes a lubricating oil passage to feed lubricating oil at an appropriate position. The lubricating oil is supplied to respective portions of the engine 10 requiring a lubrication by the oil pump 32, which configures the lubricating device, through the lubricating oil passage.

Figure 9:
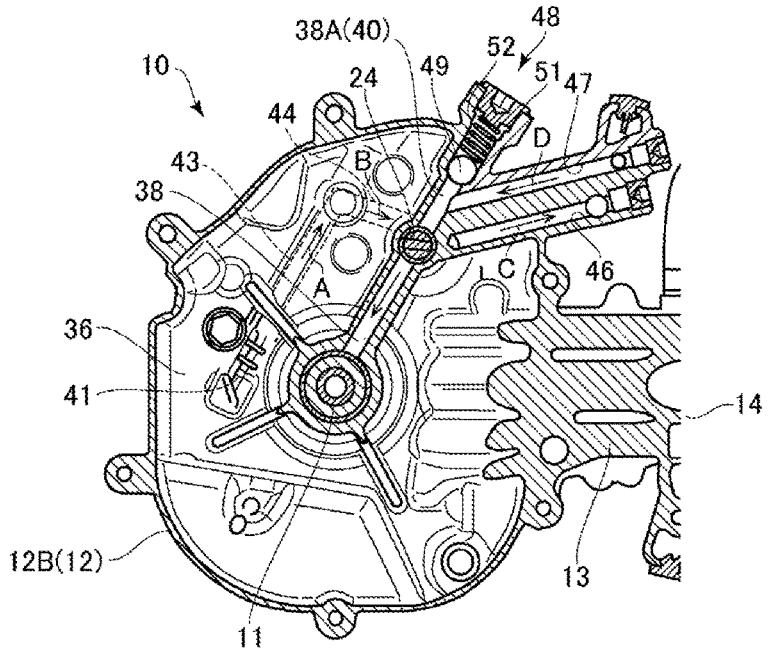
FIG. 9 is a cross-sectional plane view illustrating around a main lubricating oil passage of the engine according to the embodiment of the present invention.

The following describes a specific example of the configuration of the lubricating system. As illustrated in FIG. 6, FIG. 9, and a similar drawing, the lower engine case 12B is also configured as an oil reservoir 36 concaving downward. The lower engine case 12B accumulates a constant amount (depth) of lubricating oil. With reference to FIG. 8, as lubricating oil passages for the lubricating system, communication portions 37 and 38 are provided. The communication portion 37 communicates between the bearing 16A at the crankshaft 11 with the bearing 31A from outside the upper engine case 12A. The communication portion 38 communicates between the bearing 16B at the camshaft 24 with the bearing 31B from outside the lower engine case 12B. In this case, the communication portion 37 communicates between the bearing 16A and the bearing 31A. The communication portion 38 communicates between the bearing 16B and the bearing 31B. An extending portion 37A extends from outside the upper engine case 12A to the bearing 31A at the camshaft 24. An extending portion 38A extends from outside the lower engine case 12B to the bearing 31B at the camshaft 24. The communication portion 37 and the extending portion 37A are linearly formed, and the communication portion 38 and the extending portion 38A are linearly formed. These lubricating oil passages constitute main lubricating oil passages 39 and 40.

Figure 7A:
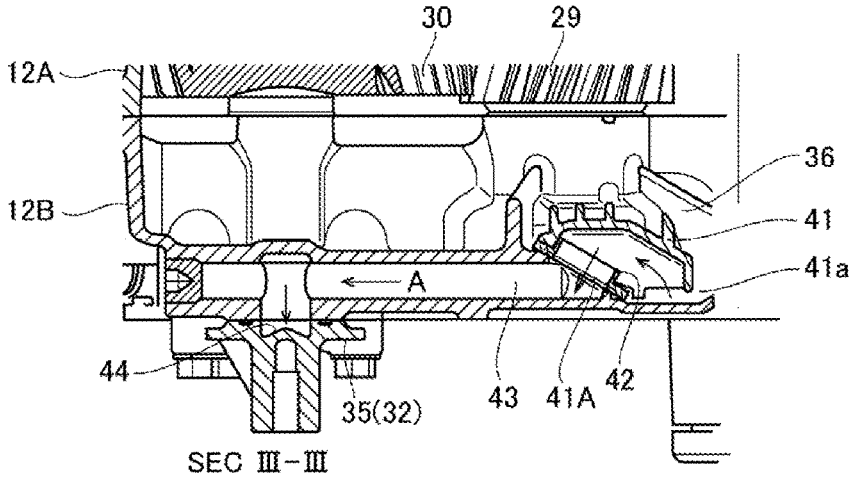
FIG. 7A is a cross-sectional view taken along the line III-III in FIG. 6.
Figure 7B:
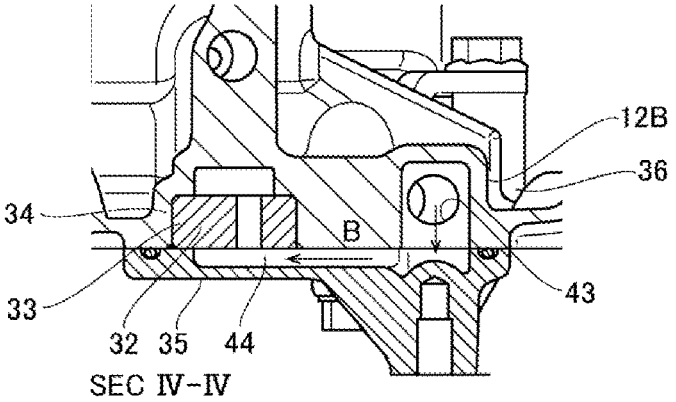
FIG. 7B is a cross-sectional view taken along the line IV-IV in FIG. 6.

As illustrated in FIG. 6, FIG. 9, and a similar drawing, a strainer 41 is disposed at a bottom surface of the oil reservoir 36 near the crankshaft 11. As illustrated in FIG. 6 and FIG. 9, the strainer 41 is secured to the lower engine case 12B so as to be disposed on the approximately opposite side from the cylinder block 13 sandwiching the crankshaft 11. As illustrated in FIG. 7A, the strainer 41 thus secured includes a suction port 41*a* for lubricating oil at a site between the strainer 41 and the bottom surface of the lower engine case 12B. As illustrated in FIG. 7A, a filter 42, which is formed by integrally molded with a filtration mesh 41A, is mounted between the strainer 41 and the lower engine case 12B. First, as illustrated in FIG. 7A, the lubricating oil in the oil reservoir 36 is supplied to the lubricating system via the suction port 41*a* at the strainer 41 by suctioning force caused by an actuation of the oil pump 32. With reference to FIG. 6, the lubricating oil that has passed through the filter 42 of the strainer 41 passes through a lubricating oil passage 43, which is formed in the lower engine case 12B as illustrated in FIG. 7A (see arrows A in FIG. 6 and in FIG. 7A). Further, as illustrated in FIG. 7B, the lubricating oil is supplied to the oil pump 32 via a lubricating oil passage 44, which is formed at the pump cover 35 (see an arrow B in FIG. 6 and FIG. 7B).

As described above, the camshaft 24 is biased to the cylinder head 14 side with respect to the crankshaft 11, and the oil pump 32 is disposed at the lower end portion 24*a* of the camshaft 24. In this case, as illustrated in FIG. 6, the main lubricating oil passages 39 and 40 on which the camshaft 24 is disposed are inclined in the cylinder head 14 direction so as to intersect with the cylinder axis line Z at an acute angle θ. The lubricating oil is pressure-fed from the oil pump 32 to the respective portions. Before pressure-fed to the respective portions, the lubricating oil is fed to an oil filter.

Figure 7C:
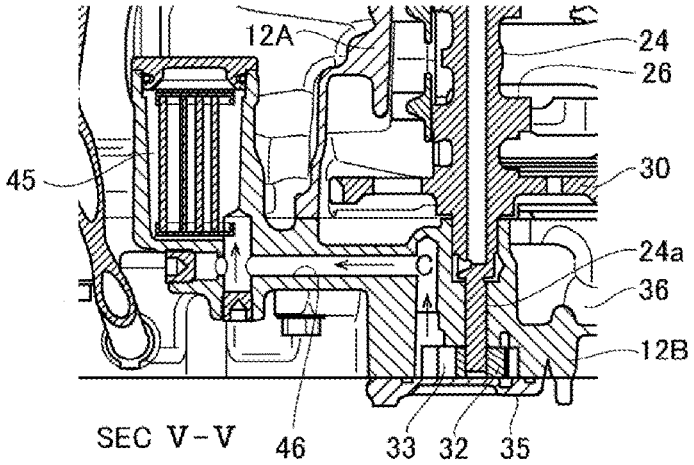
FIG. 7C is a cross-sectional view taken along the line V-V in FIG. 6.

As illustrated in FIG. 6, an oil filter 45 is disposed on the cylinder head 14 side with respect to the lower engine case 12B, which is the engine case 12, and one side in a width direction of the cylinder block 13, a side portion on the right side in the width direction in this example. As illustrated in FIG. 6, FIG. 7C, and FIG. 9, between the oil pump 32 and the oil filter 45 is communicated via the lubricating oil passage 46. The lubricating oil discharged by the oil pump 32 passes through the lubricating oil passage 46 as indicated by an arrow C in FIG. 6, FIG. 7C, and FIG. 9, and is supplied to the oil filter 45. As illustrated in FIG. 6 and FIG. 9, between the oil filter 45 and the main lubricating oil passage 40 (the extending portion 38A) is communicated via a lubricating oil passage 47. As indicated by an arrow D in FIG. 6 and FIG. 9, the lubricating oil purified by the oil filter 45 passes through the lubricating oil passage 47 and flows in the extending portion 38A.

Figure 10A:
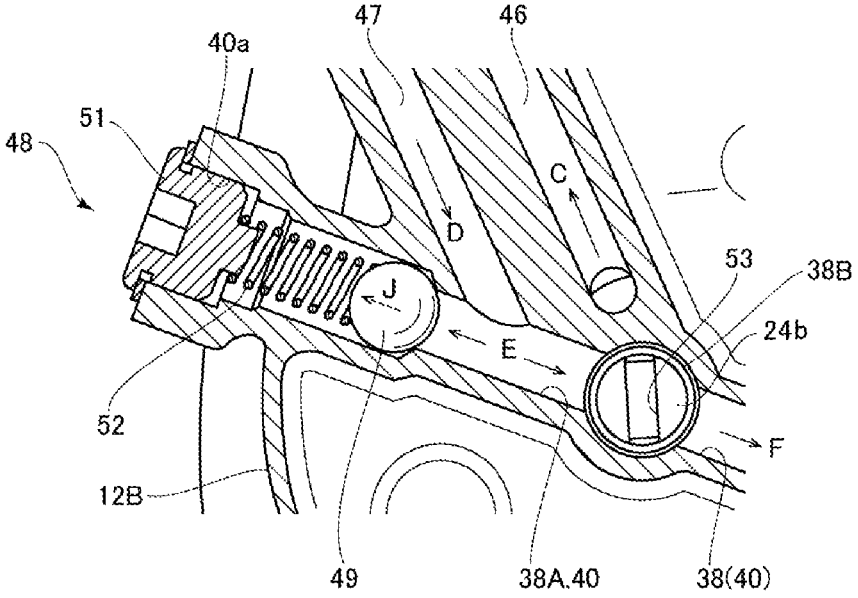
FIG. 10A is a cross-sectional plane view illustrating around a relief device of the engine according to the embodiment of the present invention.
Figure 10B:
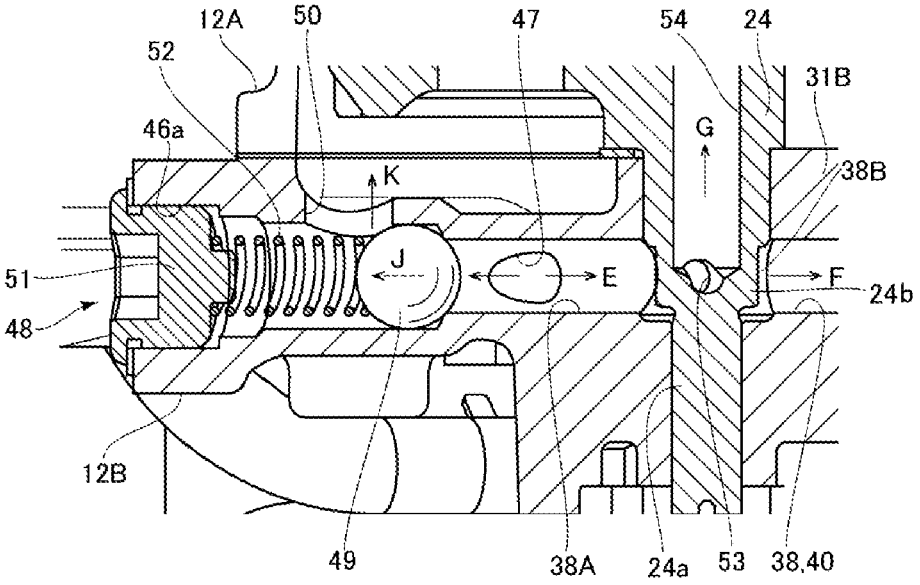
FIG. 10B is a vertical cross-sectional view illustrating around the relief device of the engine according to the embodiment of the present invention.

The lubricating oil, which flows from the lubricating oil passage 47 to the extending portion 38A (an arrow E in FIG. 10A and FIG. 10B), is subsequently pressure-fed to the respective portions via the main lubricating oil passages 39 and 40. As illustrated in FIG. 9 and a similar drawing, a relief device 48 to adjust a pressure of the lubricating oil is provided. The relief device 48 sets and maintains the pressure of the lubricating oil pressure-fed to the respective portions at a predetermined pressure. As also illustrated in FIG. 10A and FIG. 10B, the relief device 48 includes a relief valve 49 and a relief hole 50 at the extending portion 38A. When the pressure of the lubricating oil inside the extending portion 38A, namely, the main lubricating oil passage 40, becomes a predetermined pressure or more, the lubricating oil that has passed through the relief valve 49 flows out to the oil reservoir 36 via the relief hole 50 (an arrow K in FIG. 10B). The relief valve 49 is formed of a valve element that advances and retreats along an axis line of the main lubricating oil passage 40. A retainer 51 of the relief valve 49 obstructs an outer opening 40*a*, which is disposed at the extending portion 38A constituting the main lubricating oil passage 40, that opens to the outside of the lower engine case 12B. A spring 52 is mounted to the extending portion 38A to urge the relief valve 49 to a close direction. In this case, when the pressure of the lubricating oil inside the extending portion 38A becomes the predetermined pressure or more, the relief valve 49 moves against an elastic force by the spring 52 as indicated by an arrow J in FIG. 10B, thus communicating between the extending portion 38A and the relief hole 50. The relief hole 50 is drilled upward parallel to the bearings 16B and 31B of the respective crankshaft 11 and camshaft 24 on the main lubricating oil passage 40.

As illustrated in FIG. 10A and FIG. 10B, the extending portion 38A is communicated with the communication portion 38 by an annular groove passage 38B formed between the extending portion 38A, the communication portion 38, and an outer peripheral surface of a stepped portion 24*b* of the camshaft 24. As indicated by an arrow F in FIG. 10A and FIG. 10B, the lubricating oil flowing from the lubricating oil passage 47 into the extending portion 38A flows in the communication portion 38 via the annular groove passage 38B. A communication hole 53 communicating with the main lubricating oil passage 40 is formed on the camshaft 24. The extending portion 38A communicates with the communication portion 38 also via this communication hole 53. The communication hole 53 communicates with a lubricating oil passage 54, which is formed inside the camshaft 24. The lubricating oil flowing in via the communication hole 53 flows inside the lubricating oil passage 54 upward as indicated by an arrow G in FIG. 10B.

As illustrated in FIG. 8, the lubricating oil passage 54 further communicates with the communication portion 37 and the extending portion 37A at the main lubricating oil passage 39. As indicated by an arrow H in FIG. 8, the lubricating oil flowing in the communication portion 37 is fed to the bearing 16A of the upper engine case 12A.

Further, as illustrated in FIG. 4 or FIG. 8, the crankshaft 11 internally includes a communication hole 55 that communicates between a corresponding site at the bearing 16A and the crank pin 11*a* in the upper engine case 12A. Via this communication hole 55, some lubricating oil supplied to the bearing 16A is fed to the outer peripheral surface of the crank pin 11*a*.

In the above configuration, the actuation of the engine 10 drives the oil pump 32. This supplies the lubricating oil suctioned up from the oil reservoir 36 to the oil filter 45 through a lubricating oil passage 46, and the lubricating oil purified by the oil filter 45 passes through the lubricating oil passage 47 and flows in the extending portion 38A. As described above, the lubricating oil passes through the main lubricating oil passages 39 and 40 and is supplied to the bearings 16A and 16B of the crankshaft 11 to lubricate these bearings 16A and 16B. Some lubricating oil flowing in the extending portion 38A lubricates around the bearings 31A and 31B of the camshaft 24. Some lubricating oil supplied to the bearing 16A of the crankshaft 11 lubricates around the crank pin 11*a* via the communication hole 55.

The rotation of the crankshaft 11 scatters the lubricating oil supplied around the bearings 16A and 16B and the crank pin 11*a* of the crankshaft 11 into the peripheral areas. The scattered lubricating oil can lubricate around the piston 19 and the piston pin 21 and peripheral components such as the valve mechanism including the intake-side cam 25, the exhaust-side cam 26, the intake-side push rod 27, the exhaust-side push rod 28, the rocker arm, and a similar component. The lubricating oil that thus has lubricated the respective portions requiring the lubrication drops to the oil reservoir 36 for recovery. Similar to the above-described operation, the lubrication cycle in the lubricating system is continued again. Thus, smooth and proper actuation of the engine 10 is secured and maintained.

With the present invention, the engine 10 includes the linearly formed communication portion 37 and extending portion 37A and linearly formed communication portion 38 and extending portion 38A in the lubricating system to lubricate the respective portions requiring the lubrication. These lubricating oil passages constitute the main lubricating oil passages 39 and 40. In this case, the extending portion 38A includes the relief valve 49 and the relief hole 50, thus disposing and configuring the relief device 48.

Accordingly, the main lubricating oil passages 39 and 40 are linearly formed including the extending portions 37A and 38A. This ensures simply and accurately forming these sites, substantially improving the workability. Disposing the relief device 48 at the extending portion 38A eliminates the need for independently disposing and configuring the relief device 48 separately. This reduces the number of man-hours for dedicated processes, thereby ensuring achieving a cost reduction.

The oil filter 45 is disposed on the cylinder head 14 side with respect to the engine case 12 and the side portion on the one side in the width direction of the cylinder block 13 (the cylinder body).

Thus disposing the oil filter 45 at the side portion of the cylinder block 13 ensures restraining the brattice of the engine 10 in the width direction (the right-left direction) and configuring the compact engine 10. Especially, with an engine for outboard motor mounted inside an extremely narrow and small engine housing covered with the exterior cover 110, the compact engine 10 effectively contributes to the compact outboard motor 100 itself, thereby bringing various advantages in terms of handling, performance, and a similar property.

The oil pump 32 is disposed in the lower engine case 12B corresponding to the lower end portion 24*a* of the camshaft 24, which is disposed biased to the cylinder head 14 side with respect to the crankshaft 11. The main lubricating oil passages 39 and 40 are disposed inclined in the cylinder head 14 direction so as to intersect with the cylinder axis line Z at the acute angle.

Thus disposing and configuring the plurality of functional components or members associated with one another efficiently and intensively allows effectively shortening lengths of the lubricating oil passage 46 and the lubricating oil passage 47, which couple the components or members. The reduction in the number of man-hours for the machining can achieve a cost reduction required for the processes and similar work.

The relief valve 49 is formed of the valve element that advances and retreats along the axis line of the main lubricating oil passage 40. The retainer 51 of the relief valve 49 obstructs the outer opening 40*a*, which is disposed at the extending portion 38A constituting the main lubricating oil passage 40, that opens to the outside of the lower engine case 12B.

Thus the retainer 51 of the relief valve 49 also serves as the plug obstructing the outer opening 40*a* of the main lubricating oil passage 40 reduces the number of components, ensuring achieving the cost reduction.

The relief hole 50 of the relief device 48 is drilled upward parallel to the bearings 16B and 31B of the respective crankshaft 11 and camshaft 24 on the main lubricating oil passage 40.

Since the relief hole 50 can be processed from the direction identical to the bearings 16B and 31B of the crankshaft 11 and the camshaft 24, this makes it possible to improve productivity.

The lower engine case 12B is molded with a mold with a plane perpendicular to the crankshaft 11 and the camshaft 24 as a split surface, thus allowing the relief hole 50 to be molded through casting. This also ensures improving the productivity.

Additionally, at the side portion on the other side opposite from the oil filter 45 in the width direction of the cylinder block 13, the intake device 23 to supply air for engine combustion is disposed across the cylinder axis line Z.

Thus, the dimension of the outboard motor 100 especially in the width direction can be formed compact, improving operability of the outboard motor 100. The oil filter 45, which becomes a high temperature due to heat from the lubricating oil, is separated from the intake device 23. This ensures maintaining an intake temperature suctioned by the intake device 23 low, contributing to an improvement in output of the engine 10.

Since the oil filter 45 is disposed at the position close to the oil pump 32, the pipe coupling both is simplified. The oil filter 45 is disposed at the position close to the extended line of the oil passage coupling the crankshaft 11 and the camshaft 24, that is, the main lubricating oil passage 40. This ensures simplifying the oil passage after the oil has passed through the oil filter 45.

While the present invention has been described using various embodiments above, the present invention is not limited only to these embodiments. Changes and similar modifications are possible within the scope of the present invention.

For example, the oil filter 45 and the intake device 23 may be disposed with a positional relationship of left-right reversal.

The embodiment of the present invention is described with the example of the outboard motor. However, the present invention is effectively applicable to the case of apparatus, device, and a similar member mounted with the crankshaft in the vertical direction.

With the present invention, especially a main lubricating oil passage is linearly formed including an extending portion, substantially improving workability. The number man-hours for dedicated processes reduces, ensuring achieving a cost reduction.

The oil filter is disposed at the side portion of the cylinder block. This restrains a brattice of the engine in a width direction, allowing configuring the compact engine.

What is claimed is:

1. A four-cycle OHV engine comprising:

a crankshaft disposed in a vertical direction; and a camshaft parallel to the crankshaft in an engine case where the crankshaft is housed and supported, wherein:

a cylinder axis line is perpendicular to the vertical direction, the engine case includes bearings, an oil pump, lubricating oil passages, and a relief device, the bearings rotatably supporting the crankshaft and the camshaft, the oil pump and the lubricating oil passages being configured to pressure-feed lubricating oil to the bearings, the relief device being configured to adjust a pressure of the lubricating oil, the lubricating oil passages include main lubricating oil passages, the main lubricating oil passages including communication portions linearly formed with extending portions, the communication portions communicating between the respective bearings of the crankshaft and the camshaft from outside the engine case, the extending portions extending from outside the engine case to the bearing of the camshaft, and the relief device is disposed having a relief valve and a relief hole at the extending portions.

2. The four-cycle OHV engine according to claim 1, further comprising an oil filter disposed on a cylinder head side with respect to the engine case and a side portion on one side in a width direction of a cylinder body, the oil filter including a lubricating oil passage, the lubricating oil passage being coupled to the oil pump and the main lubricating oil passages disposed in the lower engine case.

3. The four-cycle OHV engine according to claim 2, wherein:

the oil pump is disposed in the lower engine case corresponding to a shaft end portion of the camshaft, the camshaft being disposed biased to the cylinder head side with respect to the crankshaft, and the main lubricating oil passages are disposed inclined in the cylinder head direction such that outer portions of the main lubricating oil passages intersect with the cylinder axis line at an acute angle.

4. The four-cycle OHV engine according to claim 1, wherein:

the relief valve is formed of a valve element that advances and retreats along an axis line of the main lubricating oil passage, and the relief valve includes a retainer, the retainer obstructing an outer opening, the outer opening being disposed at the extending portion constituting the main lubricating oil passage, the outer opening opening to outside of the lower engine case.

5. The four-cycle OHV engine according to claim 2, wherein:

the engine case is divided into an upper engine case and the lower engine case both of which integrally include the cylinder body, on the lower engine case, an oil reservoir concaving downward, the respective bearings of the crankshaft and the camshaft, and the main lubricating oil passages are integrally formed with the oil pump and the relief device, and the relief hole of the relief device is drilled upward parallel to the bearings of the respective crankshaft and camshaft on the main lubricating oil passage.

6. The four-cycle OHV engine according to claim 3, wherein:

the engine case is divided into an upper engine case and the lower engine case both of which integrally include the cylinder body, on the lower engine case, an oil reservoir concaving downward, the respective bearings of the crankshaft and the camshaft, and the main lubricating oil passages are integrally formed with the oil pump and the relief device, and the relief hole of the relief device is drilled upward parallel to the bearings of the respective crankshaft and camshaft on the main lubricating oil passage.

7. The four-cycle OHV engine according to claim 2, further comprising an intake device disposed at a side portion on the other side opposite from the oil filter in the width direction of the cylinder body across the cylinder axis line, the intake device being configured to supply air for engine combustion.

8. The four-cycle OHV engine according to claim 3, further comprising an intake device disposed at a side portion on the other side opposite from the oil filter in the width direction of the cylinder body across the cylinder axis line, the intake device being configured to supply air for engine combustion.

* * * * *